US005937245A

United States Patent [19]

Inoue et al.

[11] Patent Number: 5,937,245

[45] Date of Patent: Aug. 10, 1999

[54] IMAGE FORMING APPARATUS HAVING AN IMPROVED SYSTEM FOR REMOVING RESIDUAL TONER

[75] Inventors: Masahiro Inoue, Mishima; Yoichi Kimura, Numazu; Yoshikuni Itou, Yokohama, all of Japan

[73] Assignee: Canon Kabushiki Kaisha, Tokyo, Japan

[21] Appl. No.: 08/990,918

[22] Filed: Dec. 15, 1997

[30] Foreign Application Priority Data

Dec. 13, 1996 [JP] Japan ..... 8-334221
Dec. 4, 1997 [JP] Japan ..... 9-334110

[51] Int. Cl.[6] ..... G03G 15/02; G03G 15/24

[52] U.S. Cl. ..... 399/175; 399/150

[58] Field of Search ..... 399/149, 168, 399/169, 174, 175, 176, 50, 150

[56] References Cited

U.S. PATENT DOCUMENTS 5,412,455 5/1995 Ono et al. ..... 399/176
5,561,502 10/1996 Hirai et al. ..... 399/50
5,596,393 1/1997 Kobayashi et al. ..... 399/174
5,600,413 2/1997 Kimura ..... 399/174
5,666,606 9/1997 Okano et al. ..... 399/174
5,689,777 11/1997 Yamamoto et al. ..... 399/174
5,717,979 2/1998 Senba et al. ..... 399/50

*Primary Examiner*—S. Lee
*Attorney, Agent, or Firm*—Fitzpatrick, Cella, Harper & Scinto

[57] ABSTRACT

An image forming apparatus includes an image bearing member, latent image forming device for forming an electrostatic image on the image bearing member, the latent image forming device having a charging member contactable to the image bearing member to electrically charge the image bearing member, and the charging member being supplied with a voltage which includes an oscillation component, a developing device for developing the electrostatic latent image with toner into a toner image, the developing device being capable of removing residual toner from the image bearing member, a transfer device for transferring the toner image from the image bearing member onto a transfer material, and a frequency control device for controlling a frequency of the oscillation component so that the frequency is higher when at least a part of such an area of the image bearing member as is going to be a non-image area is charged than when such an area of the image bearing member as is going to be an image area is charged.

13 Claims, 8 Drawing Sheets

IMAGE FORMING APPARATUS HAVING AN IMPROVED SYSTEM FOR REMOVING RESIDUAL TONER

FIELD OF THE INVENTION AND RELATED ART

The present invention relates to an image forming apparatus such as a copying machine, a laser beam printer, a facsimile, or the like, which employs an electrophotographic image forming process.

In many of the electrophotographic image forming apparatuses based on the prior art, a corona type charging device has been used as a means for charging a drum type electrophotographic photosensitive member (hereinafter, it will be called "photosensitive member" for simplicity) as an image bearing member. The corona type charging device is placed along the peripheral surf ace of the photosensitive member, without being allowed to touch the surface, and the peripheral surface of the photosensitive member is charged to a predetermined polarity and potential level as the surface is exposed to the corona discharged from the corona type charging device (corona discharger).

In recent years, a contact type charging device has been put to practical use, in place of a corona type charging device. This is because a contact type charging apparatus has merit in that is produces a smaller amount of ozone than a corona type charger, and also consumes a smaller amount of electricity than a corona type charger. In the case of a contact type charging device, as a charging member supplied with voltage is placed in contact with the peripheral surface of a photosensitive member, the peripheral surface of a photosensitive member is charged to a predetermined polarity and potential level. A contact type charging apparatus which employs a magnetic brush as a charging member has been preferred to the others, in terms of reliability. In the case of a contact type charging apparatus employing this magnetic brush, electrically conductive magnetic particles are magnetically held, being aggregated in the form of a brush, in other words, forming a magnetic brush, directly on a magnet, or on a sleeve which contains a magnet. This magnetic brush is placed in contact with the peripheral surface of a photosensitive drum, which is being rotated or kept stationary, and as voltage is applied to the magnetic brush, the photosensitive drum is charged. In addition to a magnetic brush, electrically conductive fibers bound in the form of a brush (fur brush), a roller formed of electrically conductive rubber (charge roller), or the like, can be used as a contact type charging member.

In the contact type charging system called "charge injection system", a photosensitive member is provided with a charge injection layer, and a charging member supplied with voltage is placed in contact with the peripheral surface of the photosensitive member to inject charge into the charge injection layer to charge the surface of the photosensitive member to a predetermined polarity and potential level. According to this charge injection system, the peripheral surface of a photosensitive drum can be charged to substantially the same potential level as the DC bias (DC voltage) applied to a charging member, whether alternating bias (A voltage) is superposed or not. Therefore, a photosensitive drum can be charged to the same potential level while consuming a smaller amount of electricity than the other system. Also, this system does not rely on electrical discharge as a corona discharging type system does, and therefore, the amount of ozone generated by this system is much smaller.

Regarding another aspect of an image forming apparatus, in order to reduce the apparatus size, to simplify the apparatus structure, and to satisfy the ecological point of view, a so-called cleaner-less system has been recently put to practical use. In this system, the cleaning apparatus for removing the toner particles remaining on the photosensitive drum surface after a toner image is transferred onto a transfer medium, is eliminated, and instead, the remaining toner particles are recovered by the developing apparatus.

With the use of the above described cleaner-less system and contact type charging system, it is possible to make a small and simple image forming apparatus which generates practically no ozone, consumes a much smaller amount of electricity than the apparatuses employing a noncontact type charging system, and does not produce waste toner.

However, in an image forming apparatus employing a cleaner-less system and a contact type charging system, the post-transfer residual toner on a photosensitive drum (hereinafter, "residual toner") comes in contact with the charging member, and as a result, the residual toner sometimes adheres to the charging member, or mixes into the charging member.

In particular, during paper jam or in the like situation, the amount of the residual toner which adheres to, or mixes into, the charging member becomes excessive. This is because, as a typical operational malfunction, for example, transfer medium jam (paper jam), occurs, a toner image, that is, the result of the visualization, by a developing means, of an electrostatic latent image formed on a photosensitive drum, is not transferred onto a recording medium, and instead, reaches the contact type charging member.

Then, an excessively large amount toner adheres to, or mixes into, the charging member. Since the electrical resistance of commonly used toner is relatively high, the electrical resistance of the charging member increases as a large amount of toner adheres to, or mixes into, the charging member. As a result, the performance of the charging member becomes problematic. For example, it begins to nonuniformly charge the photosensitive member, or fails to charge the photosensitive member to a predetermined potential level.

In particular, when a magnetic brush is in use as the charging member, the performance of the magnetic brush is deteriorated as an excessive amount of toner is mixed into the magnetic brush. This performance deterioration of the magnetic brush creates difference in potential level between the photosensitive member and the charging member, and this difference in potential level forces the magnetic particles toward the photosensitive member, destabilizing the contact between the photosensitive member and the magnetic brush. As a result, the scale of the nonuniform charging of the photosensitive drum becomes very large. Further, some of the magnetic particles separate from the magnetic brush and mix into the developing means, effecting anomalies such as streakiness in a finished print. Also, as the amount of the magnetic particles lost from the charging member increases, the performance of the magnetic brush becomes inadequate.

SUMMARY OF THE INVENTION

Accordingly, one of the objects of the present invention is to provide an image forming apparatus capable of preventing an excessive amount of toner from adhering to, or mixing into, the charging member even if the toner which remains on the image bearing member after image transfer reaches the charging point.

Another object of the present invention is to provide an image forming apparatus capable of preventing the performance deterioration of the charging member, such as non-uniform charging, even if such a toner image that fails to be transferred due to the occurrence of an operational malfunction, for example, transfer medium jam, reaches the charging point.

Another object of the present invention is to provide an image forming apparatus suitable for returning to the photosensitive drum, the toner which adheres, or mixes into, the charging member.

Another object of the present invention is to provide an image forming apparatus capable of desirably charging an image bearing member, on the area which immediately becomes the image bearing area.

These and other objects, features and advantages of the present invention will become more apparent upon a consideration of the following description of the preferred embodiments of the present invention taken in conjunction with the accompanying drawings

DETAILED DESCRIPTION OF THE PREFERRED EMBODIMENTS

Hereinafter, the embodiments of the present invention will be described with reference to the drawings.

Embodiment 1

Figure 1:
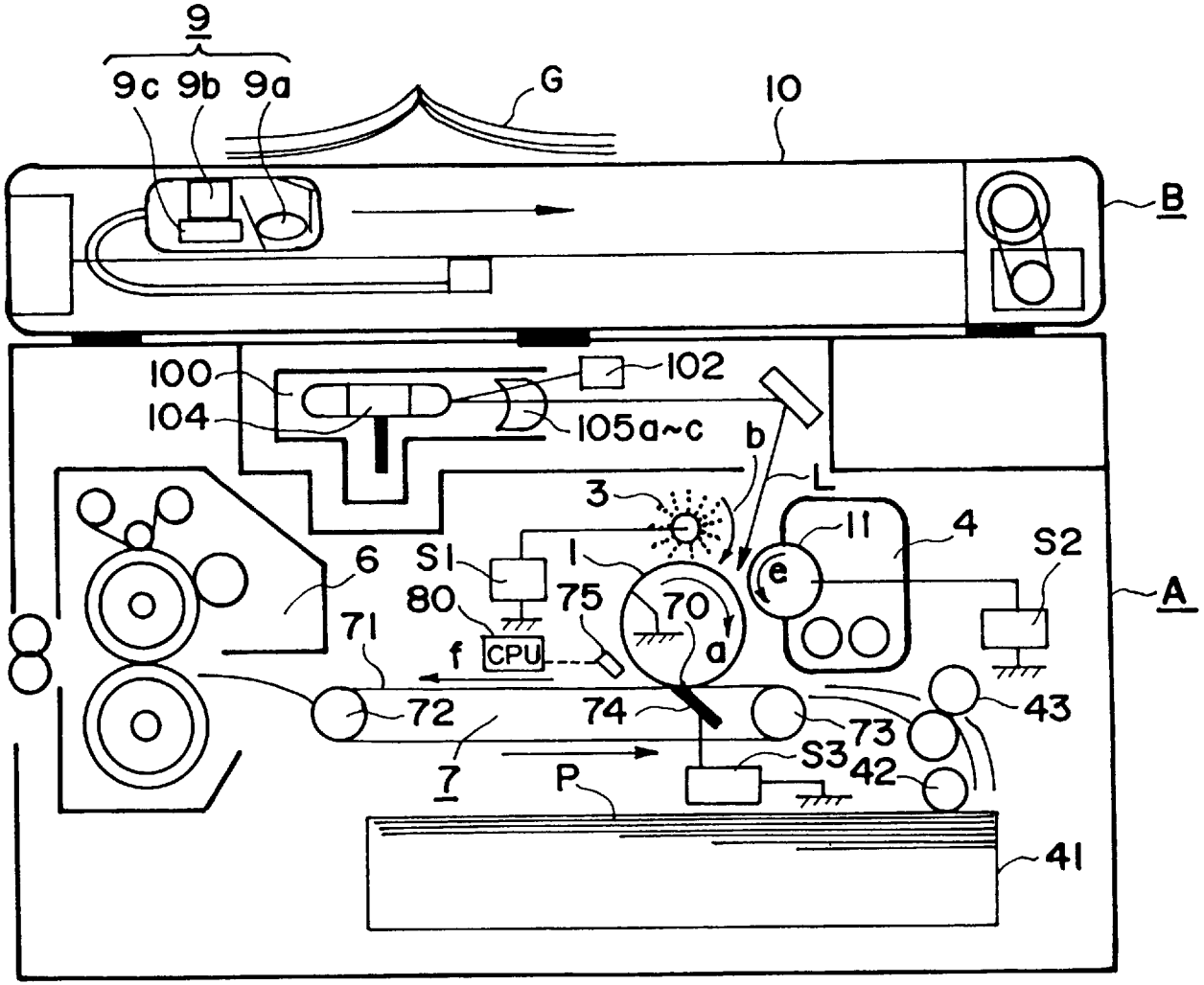
FIG. 1 is a schematic section of the image forming apparatus in the first embodiment of the present invention, and depicts the general structure of the image forming apparatus.

FIG. 1 is a schematic section of the image forming apparatus in the first embodiment of the present invention, and depicts the general structure of the apparatus. The image forming apparatus in this embodiment is a laser beam printer which employs an electrophotographic image forming process. It is a cleaner-less apparatus, and employs a contact type charging apparatus which uses a magnetic brush as a means for charging the image bearing member.

In FIG. 1, a referential letter A designates the image forming apparatus in this embodiment, which is a laser beam printer, and a referential letter B designates an image reading apparatus (image scanner), which is disposed on top of this laser beam printer A.

In the image reading apparatus B, a reference figure 10 designates an original placement glass table, on which an original G to be copied is placed, with the side to be copied facing downward. The original G placed on the glass table 10 is covered with an unillustrated original cover plate. A reference figure 9 designates an image reader unit, which contains a lamp 9*a* for illuminating the original G, a lens array 9*b* with a short focal distance, a CCD sensor 9*c,* and the like. As an unillustrated start button is pressed, the image reader unit 9, which is below the original placement glass table 10, is caused to travel rightward from the home position located on the left-hand side of the glass table 10, to a predetermined point which has been set to be the end of the rightward travel, and then return to the home position.

While the image reader unit 9 is shuttling, the downward facing surface of the original G on the original placement glass table 10 is progressively scanned from the left-hand end to the right-hand end by the light from the original illuminating lamp 9*a*. The scanning light is reflected by the downward facing surface of the original, and focused into the CCD sensor 9*c* by the short focal distance lens array 9*b*.

The CCD 9*c* is constituted of a light receiving portion, a signal transferring portion, and a signal outputting portion, which are not illustrated. As the reflected light, that is, the medium which is carrying the image information in the form of optical signals, is received by the light receiving portion, it is converted into sequential electrical signals in the form of electrical charge by the light receiving portion. The thus obtained sequential electrical signals in the form of electrical charge, or voltage, are transferred to the signal outputting portion by the signal transferring portion in synchronism with clock pulses. The signal outputting portion amplifies the sequential electrical signals in the form of electrical charge, or voltage, and outputs the amplified signals, which are analog signals. The thus obtained analog signals are converted into digital signals through a widely known image processing means, and are outputted to the printer A. In other words, the image data of the original G are optically read, and converted into sequential electrical digital signals (image signals), by the image reading apparatus B.

The laser beam printer (image forming apparatus) A comprises a photosensitive drum, as an image bearing member, in the form of a rotatory drum, which is designated by a referential figure 1. The photosensitive drum 1 is supported by a central axis, and is rotatively driven about the central axis at a predetermined peripheral velocity (process speed) in the direction of an arrow mark a, and as it is rotatively driven, its peripheral surface is uniformly charged to a predetermined polarity, which is negative in this embodiment, by a magnetic brush 3 as a contact type charging means.

The uniformly charged surface of the photosensitive drum 1 is exposed by an exposing apparatus (laser based scanning apparatus) 100; it is scanned by the laser beam L projected from the exposing apparatus 100 in modulation with the image signals outputted to the laser beam printer A from the image reading apparatus B. As a result, an electrostatic latent image correspondent to the image data of the original G photoelectrically read by the image reading apparatus B is progressively formed in correspondence with the scanning of the original G. The electrostatic latent image formed on the photosensitive drum 1 is progressively developed into a toner image by the developing apparatus 4 starting from the leading end of the latent image to the trailing end. The development process used in this embodiment is a reversal development process.

Meanwhile, transfer sheets P, for example, sheets of paper, placed in a sheet feeder cassette 4 are fed one by one into the printer A by a sheet feeder roller 42, and are delivered to a transfer nip 70 between the photosensitive drum 1 and the transfer belt 71 of a belt type transfer apparatus 7 as an image transferring means, with a predetermined timing, by the registration roller 43, and in the transfer nip 70, the toner image on the photosensitive drum 1 is transferred onto the transfer sheet P.

As for the photosensitive drum 1, any commonly used organic photosensitive member or the like may be employed, although an organic photosensitive member, the peripheral surface of which is covered with material having a volumetric resistivity of $10^9$–$10^{14}$ ohm.cm, or an amorphous silicon type photosensitive member, is preferable since a photosensitive member comprising such a surface layer can be more efficiently charged through charge injection, and therefore, is more effective for the prevention of ozone production, and reduction in electric power consumption, while improving charge characteristics. As for the measurement of the volumetric resistivity of the surface layer, material having the same composition as the surface layer is coated on a sheet of aluminum, and the volumetric resistivity of the thus formed layer is measured with a high resistance meter 4329A of Yokogawa Hewlette Packard Co., Ltd., while applying a voltage of 100 V.

Figure 2:
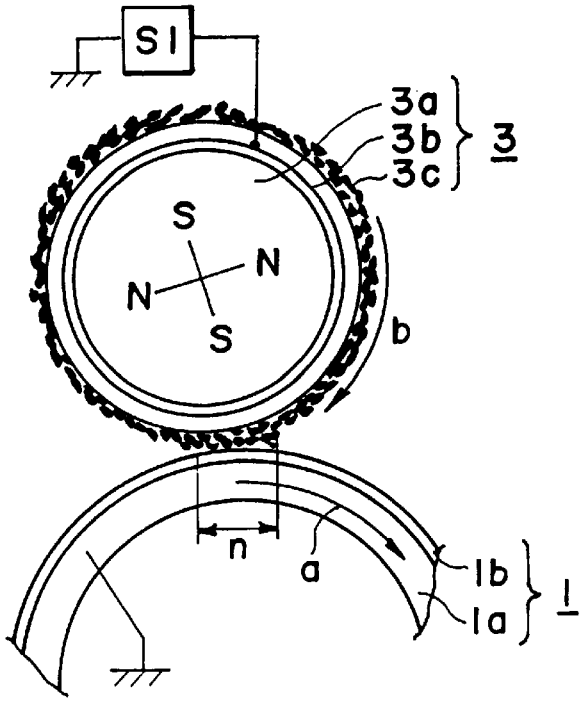
FIG. 2 is a schematic section of the magnetic brush employed in the image forming apparatus in the first embodiment of the present invention, and the adjacencies thereof, and depicts the general structure of the brush.

Referring to FIG. 2, the photosensitive drum 1 in this embodiment is an organic photosensitive member and is charged to negative polarity. It is rotatively driven at a predetermined process speed (for example, 100 mm/sec). It comprises a base member 1*a,* which is an aluminum cylinder with a diameter of 30 mm, and a photosensitive layer 1*b* coated on the peripheral surface of the aluminum base member 1*a*. The photosensitive layer 1*b* has five sub-layers coated in layers on the peripheral surface of the base member 1*a*.

The first layer, that is, the bottommost sublayer, of the photosensitive layer 1*b* is a 20 μm thick electrically conductive undercoat layer, which is provided for rectifying the defects of the base member 1*a*. The second layer is a 1 μm-thick medium resistance layer for blocking positive charge. It plays a role in preventing the negative charge injected into the peripheral surface of the photosensitive drum 1, from being canceled by the positive charge from the aluminum base member 1*b*. It is composed of Amilan resin and methoxy-methyl nylon, and its resistance has been adjusted to approximately $10^6$ ohm.cm. The third layer is charge generation layer. It is an approximately 0.3 μm thick layer composed by dispersing diazo pigment in resin material. It generates positive-negative charge pairs as it is exposed to light. The fourth layer is a charge transfer layer, that is, a layer of P-type semiconductor composed by dispersing hydrazone in polycarbonate resin.

Therefore, the negative charge given to the peripheral surface of the photosensitive drum 1 cannot pass through this layer, and only the positive charge, which is generated in the third layer (charge generation layer), is allowed to transfer to the peripheral surface of the photosensitive drum 1. The fifth layer, the outermost layer, is a charge injection layer, which is a layer of a material composed by dispersing electrically conductive filler in electrically nonconductive resin. More specifically, microscopic particles of $SnO_2$ doped with antimony to reduce electrical resistance (to make it electrically conductive), which are approximately 0.03 μm in particle diameter, are dispersed in electrically nonconductive binder resin by a weight ratio of 70%. Then, this material is coated to a thickness of approximately 3 μm using a proper coating method, for example, the dip method, spray method, roller coat method, beam coat method, or the like, to form the charge injection layer.

Referring to FIG. 2, the contact type charging means in this embodiment is constituted of a magnetic brush type charging apparatus (hereinafter, "magnetic brush") 3. The magnetic brush 3 is a rotatory sleeve type. In other words, it comprises a magnetic roller 3*a,* a nonmagnetic SUS sleeve 3*b,* and a magnetic brush layer 3*c*. The magnetic roller 3*a* is 16 mm in diameter and is nonrotatively fixed. The sleeve 3*b* is rotatively fitted around the peripheral surface of the magnetic roller 3*a*. The magnetic brush layer 3*c* is a layer of magnetic particles (magnetic carrier) held on the peripheral surface of the sleeve 3*b* by the magnetic force of the magnetic roller 3*a*.

As for the magnetic particles which form the magnetic brush layer 3*c,* those which are 10–100 μm in average particle diameter, 20–200 emu/$cm^3$ in saturation magnetization, and $1\times10^2$–$1\times10^{10}$ ohm.cm in electrical resistance, are desirable; preferably, those which have an electrical resistance of $1\times10^6$ ohm.cm or higher, in consideration of the possibility that the photosensitive drum 1 has a defect in terms of electrical insulation, for example, a pin hole. As for the resistance value of the magnetic particle, two grams of magnetic particles are placed in a metallic cell having a bottom surface area of 228 $mm^2$, and are packed with a pressure of 6.6 kg/$cm^2$. Then, the resistance value is measured while applying 100 V.

In order to improve the charging performance of the magnetic brush 3, the electrical resistance of the magnetic particle is desired to be as small as possible. In this embodiment, such magnetic particles that are 25 μm in average particle diameter, 200 emu/$cm^3$ in saturation magnetization, and $5\times10^6$ ohm.cm in resistance are used. These magnetic particles are magnetically held on the peripheral surface of the sleeve 3*b* to form the magnetic brush 3. As for the magnetic particles, they are formed by dispersing magnet particles, and carbon black for resistance adjustment, in resin carrier, or particles of pure magnetite such as ferrite are used. In the latter case, the surface of the magnetite particle is coated with resin to adjust resistance.

The magnetic brush layer 3*c* of the magnetic brush 3 is positioned to remain in contact with the peripheral surface of the photosensitive drum 1. The width of the contact nip portion n (charge nip portion) between the magnetic brush layer 3*c* and the photosensitive drum 1 is 6 mm. The sleeve 3*b* is rotatively driven in the direction of an arrow b at a peripheral velocity of, for example, 150 mm/sec while the photosensitive drum 1 is rotatively driven in the direction of the arrow mark a at a peripheral velocity of 100 mm/sec. In other words, the rotational directions of the sleeve 3*b* and the photosensitive drum 1 in the contact nip n are opposite to each other. As the sleeve 3*b* is rotatively driven while being supplied with a predetermined charge bias voltage from an electrical power source S1, the peripheral surface of the photosensitive drum 1 is rubbed by the magnetic brush layer 3*c,* and electrical charge is uniformly injected into the peripheral surface of the photosensitive drum 1; the surface of the photosensitive layer 1*b* of the photosensitive drum 1 is uniformly charged to a desired potential level (primary charge). The reason for setting the peripheral velocity of the sleeve 3*b* to be higher than that of the photosensitive drum 1 is that such an arrangement causes the residual toner on the photosensitive drum 1 to come in contact with a larger amount of the magnetic particles of the magnetic brush 3, and as a result, the residual toner is more efficiently absorbed by the magnetic brush 3.

Figure 3:
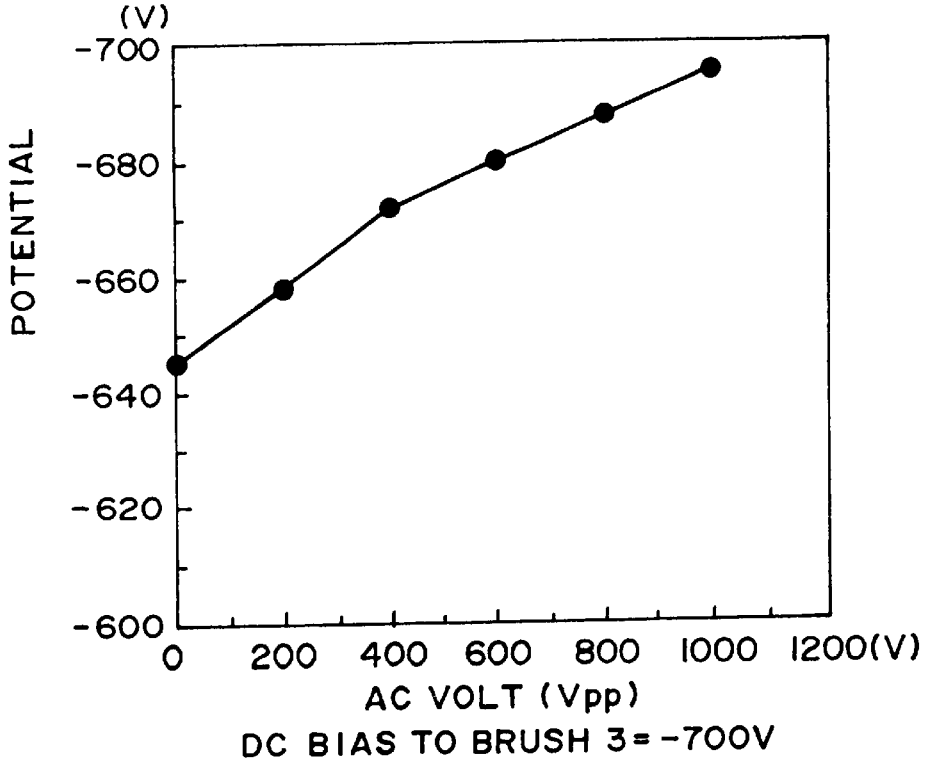
FIG. 3 is a graph which shows the relationship between the alternating voltage applied to a magnetic brush and the attained potential level.

FIG. 3 shows the relationship between the amplitude of the oscillating component, that is, an alternating voltage (AC voltage having a rectangular waveform and a frequency of 1000 Hz), of the bias applied to the magnetic brush 3, and the potential level of the photosensitive drum 1 after a single rotation of the photosensitive drum 1. As is evident from FIG. 3, as the amplitude is increased, the difference between the value of the DC component of the applied bias, and the value of the potential level of the photosensitive drum 1 after the single rotation, becomes smaller, whereas as the frequency of the oscillating component is increased, the difference between the value of the DC component and the potential level becomes larger. Describing in more detail, the photosensitive drum 1 is more desirably charged in terms of uniformity when the potential contrast $\Delta V(=|Vdc-Vs|)$, that is, the difference between the DC component Vdc of the bias applied to the magnetic brush 3, and the surface potential level Vs to which the photosensitive drum 1 is charged with the Vdc, is no more than 40 V.

The reason for applying an alternating voltage to the magnetic brush 3 is as follows. An alternating voltage applied to the magnetic brush 3 generates an alternating electric field between the photosensitive drum 1 and the magnetic brush 3, and this alternating electric field vibrates the particles between the photosensitive drum 1 and magnetic brush 3. As a result, the efficiency with which the residual toner is absorbed by the magnetic brush 3 is improved. Thus, a compound voltage composed of DC voltage and alternating voltage is applied to the magnetic brush 3. In this embodiment, the DC voltage was −700 V, and the alternating voltage was rectangular in waveform, 1000 Hz in frequency, and 800 V in peak-to-peak voltage. As a result, the photosensitive drum 1 was desirably charged.

As the residual toner on the photosensitive drum 1 is absorbed by the magnetic brush type charger, the magnetic brush 3 is allowed to make direct contact with the peripheral surface of the photosensitive drum 1, across the entire image formation area. As a result, the photosensitive drum 1 is desirably charged. Normally, the residual toner absorbed by the magnetic brush 3 is triboelectrically charged to negative polarity by the magnetic brush 3, and then is gradually expelled onto the photosensitive drum 1 due to the difference between the DC voltage level and the potential level of the photosensitive drum 1.

The frequency of the alternating component of the voltage applied to the charging device is desired to be in a range of 500–3000 Hz. This is because excessively low frequency causes the charge to be nonuniform, whereas excessively high frequency gradually deteriorates the performance of the charging device while the charger is used for an extended period.

Figure 4:
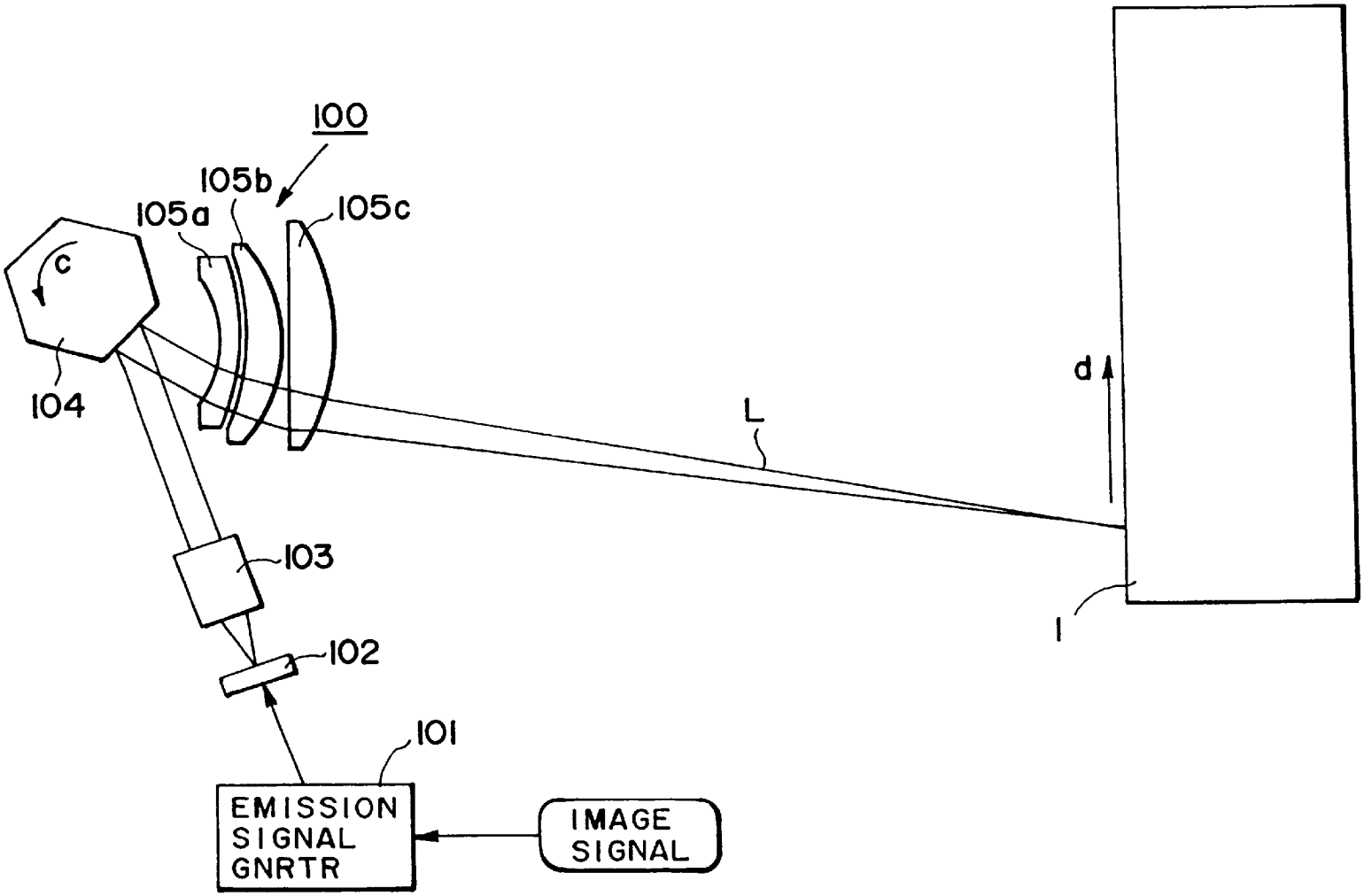
FIG. 4 is a schematic drawing of the exposing apparatus (laser based scanning apparatus) employed in the image forming apparatus in the first embodiment of the present invention, and depicts the general structure of the exposing apparatus.

FIG. 4 is a schematic section of the exposing apparatus 100 which employs a laser beam based scanning system. It depicts the general structure of the apparatus. The exposure of the peripheral surface of the photosensitive drum 1, that is, the scanning of the peripheral surface of the photosensitive drum 1 by the laser beam L projected from the exposing apparatus 100, occurs in the following manner. First, a solid-state laser element 102 is turned on and off with predetermined timing by the driver signals sent from a signal generator 101 in which the driver signals are modulated with image signals. The laser light emitted from the solid-state laser element 102 is converted into a substantially parallel pencil of rays, or a laser beam, by a collimator lens system 103, and then is deflected by a polygon mirror 104 which is rotating at a high speed in the direction of an arrow mark c, being thereby caused to scan in the direction of an arrow mark d. Then, the scanning laser beam is focused, as a scanning spot of light, on the peripheral surface of the photosensitive drum 1 by the f-θ lens group comprising lenses 105*a,* 105*b* and 105*c,* and is caused to scan the peripheral surface of the photosensitive drum 1. As a result, the potential level of the photosensitive member changes, across the area scanned by the laser beam, in correspondence with the scanned portion of the original image. Each time the laser beam scans from one edge of the original to the other edge, the original and the exposing apparatus are scrolled a predetermined distance, relative to each other, in the direction perpendicular to the axis of the photosensitive drum 1. As a result, the potential level of the peripheral surface of the photosensitive drum 1 reflects the original image; in other words, an electrostatic latent image of the original is formed on the peripheral surface of the photosensitive drum 1.

In short, a laser beam is emitted from the solid-state laser element 102 which is turned on and off in response to the image signals. This laser beam is moved in a scanning manner by the polygon mirror 104 which is rotating at a high speed. Then, the uniformly charged peripheral surface of the photosensitive drum 1 is exposed to this scanning laser beam. As a result, an electrostatic latent image, which reflects the original, is progressively formed starting from the leading end.

Figure 5:
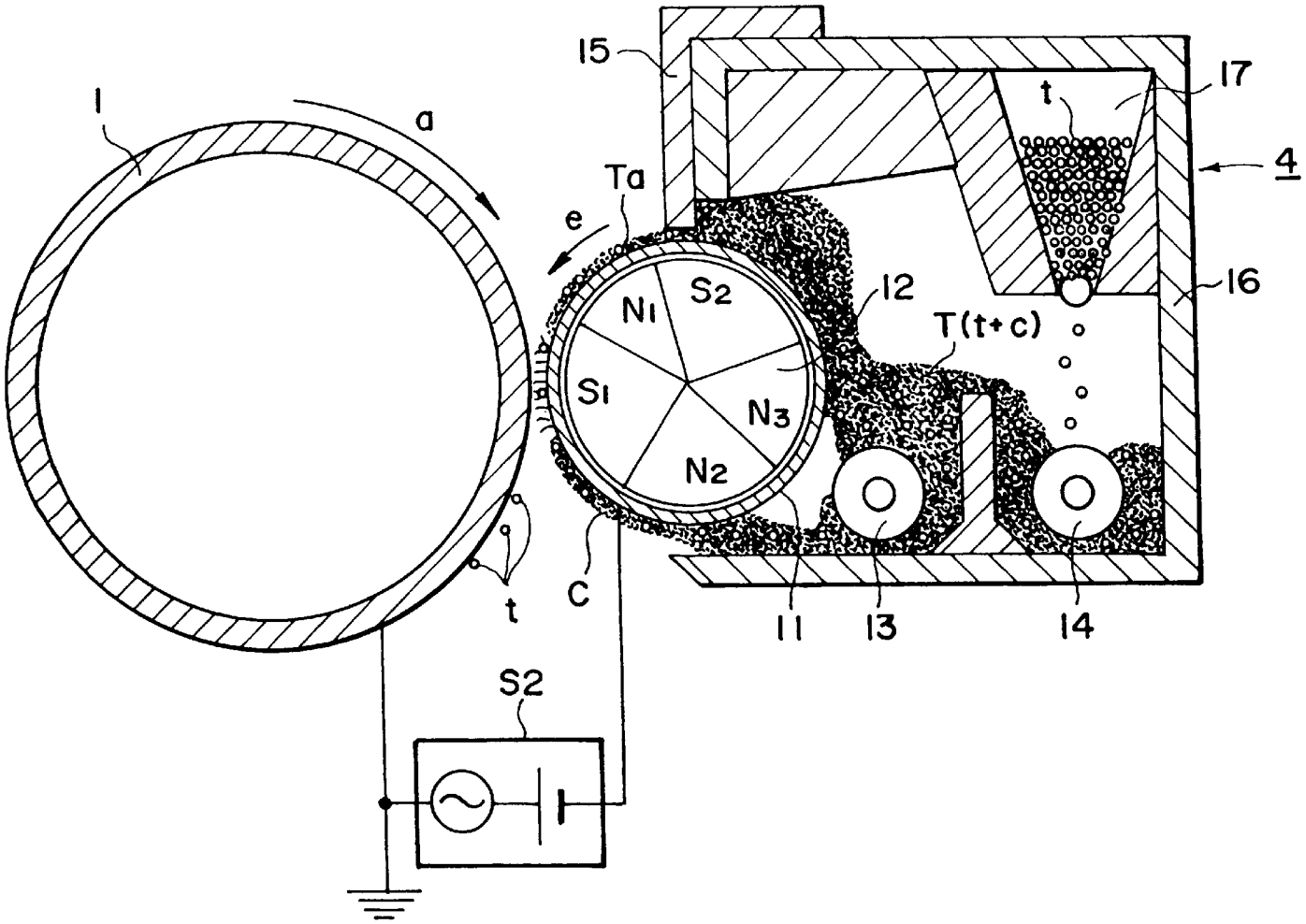
FIG. 5 is a schematic section of the developing apparatus employed in the image forming apparatus in the first embodiment of the present invention, and depicts the general structure of the developing apparatus.

FIG. 5 is a schematic section of the developing apparatus in this embodiment, and depicts the general structure of the apparatus. This developing apparatus 4 is a contact type developing apparatus, which employs a magnetic brush, and uses developer composed of two components. In this drawing, a referential figure 11 designates a development sleeve, which is rotatively driven in the direction of an arrow mark c; 12, a cylindrical magnet fixed within the development sleeve; 13 and 14, stirring screws; 15, a regulator blade for forming a thin layer of developer T on the peripheral surface of the development sleeve 11; 16, a developing apparatus frame/container; and a referential figure 17 designates a toner hopper for refill toner.

The development sleeve 11 is disposed adjacent to the photosensitive drum 1 so that the distance between the peripheral surfaces of the development sleeve 11 and photosensitive drum 1, at the point at which the distance is the smallest, becomes approximately 500 μm. In other words, the development sleeve 11 is disposed so that the thin layer Ta of the developer T is allowed to contact the photosensitive drum 1 to develop the latent image on the photosensitive drum 1. The toner t, that is, the main ingredient of the developer T used in this embodiment, is 6 μm in average particle diameter, and is charged to negative polarity. It contains titanium oxide particles with an average particle diameter of 20 nm, by 1 wt. %. As for the carrier c, magnetic carrier is used, which is 205 emu/cm$^3$ in saturation magnetization, and 35 μm in average particle diameter. The weight ratio between the toner t and the carrier c in the developer T is 6:94.

At thin time, the development process through which the electrostatic latent image on the photosensitive drum 1 is visualized, and the system which circulates the developer T, will be described. The development process in this embodiment is carried out by the developing apparatus 4 which employs a magnetic brush, and uses the developer T composed of two components.

As the development sleeve 11 is rotated, the developer T is picked up on the peripheral surface of the development sleeve 11 by the pole N2, and is conveyed by the development sleeve 11, passing the pole S2 and then pole N1. While the developer T is conveyed from the region correspondent to the pole S1 to the region correspondent to the pole N1, it is regulated by the regulator blade 15 disposed in perpendicular to the development sleeve 11, and is formed into a thin layer Ta of the developer T on the peripheral surface of the development sleeve 11. As the thin layer Ta of the developer T is farther conveyed, it enters the region correspondent to the pole S1. In this region, the particles of the developer T are caused to aggregate in the form of a brush, by the magnetic force. This brush of developer T develops the electrostatic latent image on the photosensitive drum 1. Thereafter, the developer T on the development sleeve 11 is dropped into the developer container/frame 16 by the mutually repellent magnetic fields of the poles N3 and N2.

To the development sleeve 11, DC voltage and AC voltage are applied from an electrical power source S2. In this embodiment, the DC voltage is −500 V, and the AC voltage has a frequency of 2000 Hz, and a peak-to-peak voltage of 1500 Vpp.

Generally speaking, in a two-component developing method, application of alternating current voltage improves development efficiency, and image quality, but is liable to cause fog. Normally, the appearance of this type of fog can be prevented by providing an appropriate gap between the level of the DC voltage applied to the developing apparatus 4, and the potential level to which the surface of the photosensitive drum 1 is charged.

The transferring apparatus 7 in this embodiment is of a belt type, in which an endless transfer belt 71 is stretched around a driver roller 72 and a follower roller 73, and is rotatively driven in the direction of an arrow mark f, at substantially the same peripheral velocity as that of the photosensitive drum 1. On the inward side of the transfer belt 71, a blade 74 for delivering transfer charge is disposed to place the outward surface of the transfer belt 71 in contact with the peripheral surface of the photosensitive drum 1; the point of the contact between the transfer belt 71 and the photosensitive drum 1 is correspondent to the approximate center portion between the driver roller 72 and the follower roller 73. A transfer sheet P is conveyed to a transfer nip 70 by the transfer belt 71, riding on the outward surface of the transfer belt 71 while the transfer belt 71 is running through the top portion of the belt loop. At the same time as the leading edge of the transfer sheet P enters the transfer nip 70, a predetermined transfer bias begins to be supplied to the transfer charge delivery blade 74 from an electrical power source S3 for transfer bias application. As a result, the transfer sheet P is charged to the polarity opposite to that of the toner t from the back (bottom) side, causing the toner image on the peripheral surface of the photosensitive drum 1 to be progressively transferred onto the top surface of the transfer sheet P.

The transfer belt 71 in this embodiment is formed of polyimide resin, and its thickness is 75 μm. The material for the transfer belt 71 does not need to be limited to polyimide resin. For example, plastic material such as polycarbonate resin, polyethylene-terephthalate resin, polyvinylidene fluoride resin, polyethylene-naphthalate resin, polyether ether-ketone resin, polyether sulfone resin, and polyurethane resin, or elastic material such as fluorinated rubber and silicone rubber, are also desirable material. Also, the thickness of the transfer belt 71 is not limited to 75 μm, as long as it is in a range of 25–2000 μm, preferably, in a range of 50–150 μm. The transfer charge delivery blade 74 in this embodiment is 2 mm in thickness, and 306 mm in length. It has an electrical resistance of $1\times10^5$–$1\times10^7$ ohm. The bias applied to the transfer charge delivery blade 74 to transfer the toner image is controlled so that a constant current of 15 μA flows through the transfer charge delivery blade 74.

As described above, the toner image formed on the peripheral surface of the photosensitive drum 1 is transferred onto the transfer sheet P by the transfer charge delivery blade 74. The transfer belt 71 doubles as a means for conveying the transfer sheet P from the transfer nip 70 to a fixing apparatus 6. After passing through the transfer nip 70, the transfer sheet P is separated from the peripheral surface of the photosensitive drum 1, and then is conveyed to the fixing apparatus 6 by the transfer belt 7.

On the downstream side of the transfer nip 70, relative to the rotational direction of the photosensitive drum 1, a transfer sheet detection sensor 75 is disposed adjacent to the photosensitive drum 1. The sensor 75 is connected to a controlling apparatus (CPU) 80. The sensor 75 detects the presence of the transfer sheet P on the downstream side of the transfer nip 70, relative to the rotational direction of the photosensitive drum 1.

Figure 6:
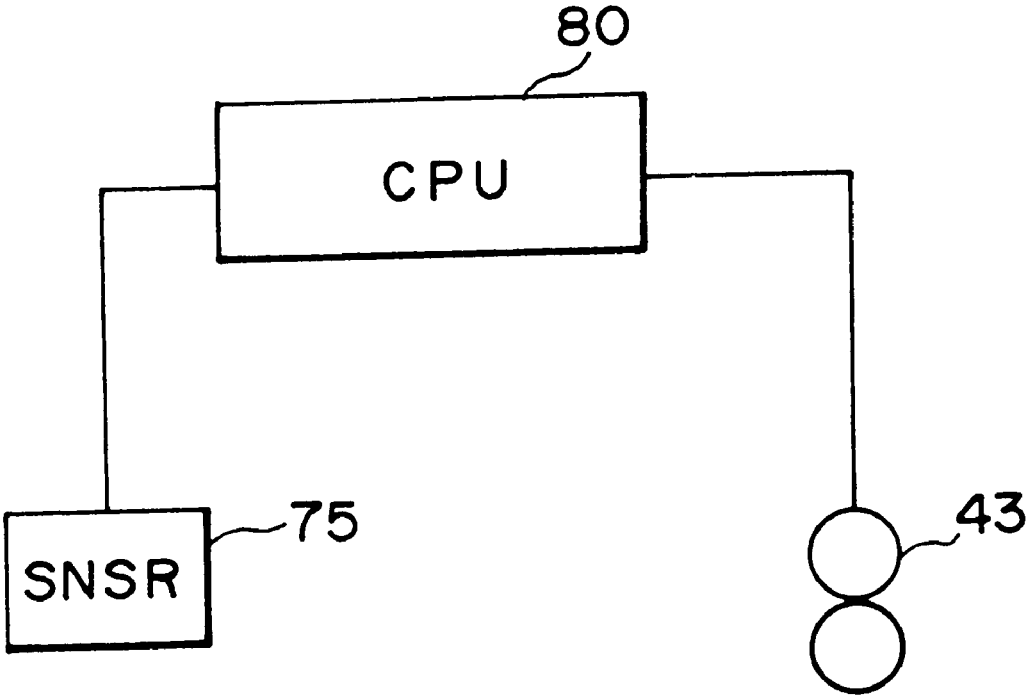
FIG. 6 the circuit diagram for determining whether or not paper jam has occurred.

Referring to FIG. 6, the controlling apparatus (CPU) so tracks the movement of the transfer sheet P based on the time which elapses after a registration roller 43 signals the entrance of the transfer sheet P, and also calculates the normal length of time necessary for the transfer sheet P to pass through the transfer sheet detection sensor 75, based on the size of the transfer sheet P currently in use. If the aforementioned elapsed time or passing time is longer than a predetermined length, the controlling apparatus (CPU) 80 determines that paper jam has occurred (transfer sheet P has stuck). Also, the controlling apparatus (CPU) 80 controls the operation of the laser beam printer (image forming apparatus) A and the image reading apparatus B. If the controlling apparatus (CPU) determines, based on the transfer sheet detection signal from the transfer sheet detection sensor 75, that paper jam has occurred, the controlling apparatus (CPU) 80 controls the power source S1 so that the oscillating component (AC component) of the charge bias voltage applied to the sleeve 3*b* of the charging device is changed from the normal state (details will be described later).

Next, the operation of the aforementioned image forming apparatus (laser beam printer) A will be described.

When forming an image, the photosensitive drum 1 is rotatively driven in the direction of the arrow mark a by a driving means (unillustrated), and while it is rotated, its peripheral surface is uniformly charged by the magnetic brush 3. The charged surface of the photosensitive drum 1 is exposed, or scanned, by the laser beam L projected from the exposing apparatus (laser based scanning apparatus) 100. As a result, an electrostatic latent image is formed on the photosensitive drum 1, in correspondence with the inputted image data. The electrostatic latent image is developed into a toner image by the developing apparatus, through a reversal development process. Meanwhile, the transfer sheet P such as a cut sheet, which has been stored in a cassette 41, is fed into the image forming apparatus, and is conveyed to the transfer nip 70 between the photosensitive drum 1 and the transfer belt 71 of the transferring apparatus 7 by the registration roller 43 so that it arrives at the transfer nip 70 at the same time as the toner image on the photosensitive drum 1 arrives at the transfer nip 70. As the toner image and the transfer sheet P arrive at the transfer nip 70, transfer bias is applied to the transfer charge delivery blade 74, which charges the transfer sheet P to the polarity opposite to that of the toner t, from the back side of the transfer sheet P. As a result, the toner image is transferred onto the front, or top, surface of the transfer sheet P. Then, the transfer sheet P with the transferred toner image is conveyed to the fixing apparatus 6 by the transfer belt 71. In the fixing apparatus 6, the toner image is permanently fixed to the transfer sheet P. Thereafter, the transfer sheet P with the fixed toner image is discharged as a permanent copy, from the fixing apparatus 6.

The residual toner, that is, the toner which remains on the photosensitive drum 1 after the toner image transfer is absorbed by the magnetic brush 3 as it arrives at the charging point for the photosensitive drum 1. The residual toner absorbed by the magnetic brush 3 is expelled from the magnetic brush 3 as its polarity changes to negative. At the same time as the residual toner is absorbed from the peripheral surface of the photosensitive drum 1 by the magnetic brush 3, the surface area front which the residual toner is absorbed is charged by the magnetic brush 3 to be used as the image formation area. Since the residual toner which has been absorbed in the magnetic brush 3 and changed in polarity is continuously expelled from the magnetic brush 3 by a small amount, the area to be used as the image formation area is covered with the small amount of the residual toner which has been converted in polarity. Next, on this very area covered with the small amount of the converted toner, an electrostatic latent image is formed through the aforementioned exposure process. Then, the converted residual toner on the photosensitive drum 1 is cleared by the developing apparatus at the same time as the electrostatic latent image is developed by the developing apparatus. More specifically, the DC voltage applied by the developing apparatus to develop the electrostatic latent image is of a specific level which falls between the dark potential level and the light potential level. Therefore, the applied DC voltage generates such an electric field that causes the toner on the development sleeve to adhere to the dark area, and at the same time, causes the converted residual toner on the photosensitive drum 1 to adhere to the development sleeve. After the development process, the operation for removing the residual toner goes back to the start.

However, if the transfer sheet conveyance system of the image forming apparatus fails, and the transfer sheet P is improperly conveyed, in other words, if paper jam occurs, a large amount of the toner from the toner image remains on the photosensitive drum 1 without being transferred onto the transfer sheet P. If the image forming operation is continued with the photosensitive drum 1 in this condition, the magnetic brush 3 is contaminated.

In order to prevent the above-described contamination of the magnetic brush 3, the controlling apparatus (CPU) 80 of the image forming apparatus in accordance with the present invention takes the following action. That is, as the controlling apparatus (CPU) 80 determines, based on the signal from the transfer sheet detection sensor 75, that paper jam has occurred, it stops all operations directly related to image formation, and informs the apparatus operator of the paper jam by displaying a paper jam message on an unillustrated display or the like. After the jammed transfer sheet P is removed, the controlling apparatus (CPU) 80 executes the following reset sequence.

Figure 9:
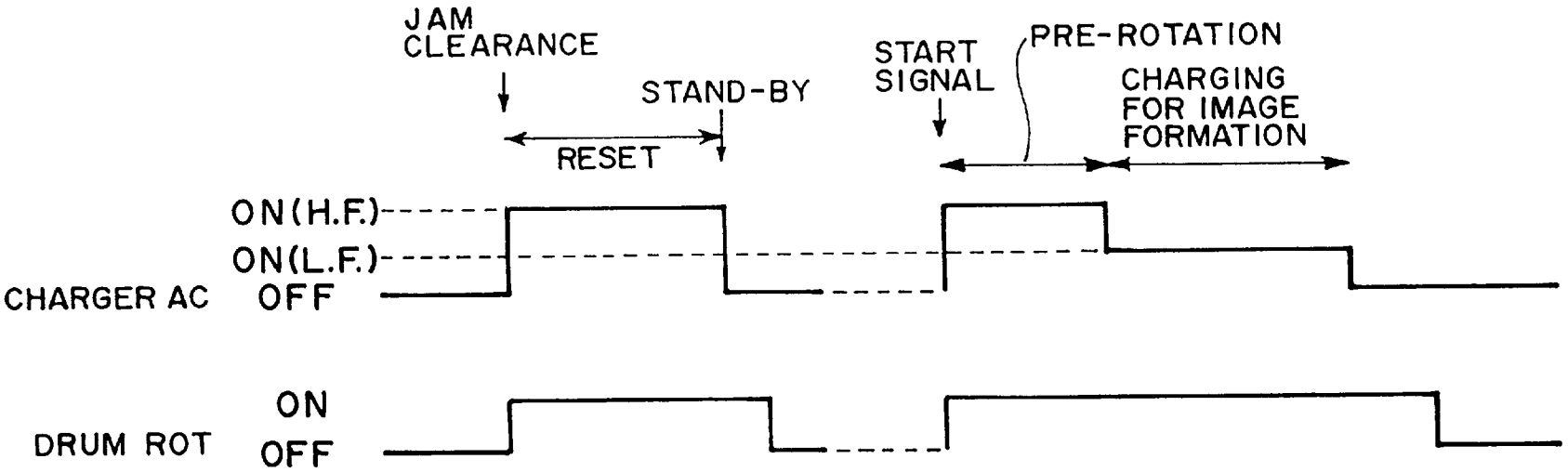
FIG. 9 is the timing chart for the AC voltage applied to the charging device.

Referring to FIG. 9, in this reset sequence, the frequency of the oscillating component of the voltage applied to the sleeve 3*b* of the charging device is increased compared to the frequency in the normal sequence, and at the same time, the transfer bias is turned off so that the sleeve 3*b* is not charged for image transfer. In other words, a given area, which passes through the charging point during the reset sequence, of the portion of the peripheral surface of the photosensitive drum 1, is not subjected to the developing process in the developing apparatus.

During this reset sequence, the developing apparatus 4 is allowed to operate in the same manner as it does in the normal image forming operation, except that the DC component of the development bias applied to the development sleeve 11 from the electrical power source S2 is slightly lowered in absolute value; it is lowered from −500 V, which is the normal voltage applied during image formation, to −450 V.

As the post-paper jam sequence is carried out with the provision of the above-described setup, the portion of the toner image, which is on the photosensitive drum 1, on the area between the developing apparatus and the transfer apparatus 7, arrives at the magnetic brush 3 without being exposed to the transfer charge, and therefore, the polarity of the toner of this untouched toner image on the photosensitive drum 1 remains negative, that is, the same as it is immediately after the development process. Since the magnetic brush 3 is supplied with an alternating voltage which is higher in frequency than the normal alternating voltage, the charging performance of the magnetic brush 3 is less than its normal performance; the charging performance of a magnetic brush type charging device reduces if the frequency of the alternating voltage applied to the charging device is increased beyond a certain level. Therefore, the difference in voltage between the DC component of the charge applied to the sleeve 3*b*, and the potential level to which the photosensitive drum 1 is charged, increases. Consequently, most of the toner of the toner image which is not transferred onto the transfer sheet P and reaches the magnetic brush 3, is not captured by the magnetic brush 3. As for the developing apparatus 4, on the other hand, the absolute value of the DC component of the development bias has been changed (to −450 V) in correspondence with the voltage of the potential of the peripheral surface of the photosensitive drum 1, and therefore, there is sufficient potential difference for the developing apparatus 4 to recover the toner of the untransferred toner image, hence fogging is prevented. In other words, during the post-paper reset sequence, the frequency of the oscillating component of the voltage applied to the sleeve 3*b* of the charging device is rendered higher than during the normal image formation sequence, and therefore, the charging performance of the sleeve 3*b* becomes lower, which causes the potential level, to which the photosensitive drum 1 is charged, to be lower than the normal potential level for the normal image formation sequence. Therefore, the voltage of the DC component of the development bias applied to the sleeve 3*b* should also be rendered lower during the post-paper jam reset sequence than during the normal image formation sequence.

The length of the time for the post-paper jam reset sequence, during which the frequency of the AC voltage applied to the sleeve 3*b* of the charging device is to be rendered higher than the frequency during the normal image formation sequence, and the absolute value of the DC component of the development bias is to be kept at a value different from the normal value, is from the moment of the paper jam signal reception by the controlling apparatus (CPU) 80 until the strip of the peripheral surface of the photosensitive drum 1, across which the development process is being carried out at the time of the paper jam signal reception by the controlling apparatus (CPU) 80, (the strip of the peripheral surface of the photosensitive drum 1, which is in the development nip 70 at the time of the paper jam signal reception by the controlling apparatus (CPU) 80), passes at least the magnetic brush 3.

If the toner of the untransferred toner image on the photosensitive drum 1 cannot be completely recovered by the developing apparatus 4 through the first rotation of the photosensitive drum 1 in the post-paper jam reset sequence, the length of the time for the post-paper jam reset sequence should be rendered longer.

Figure 7:
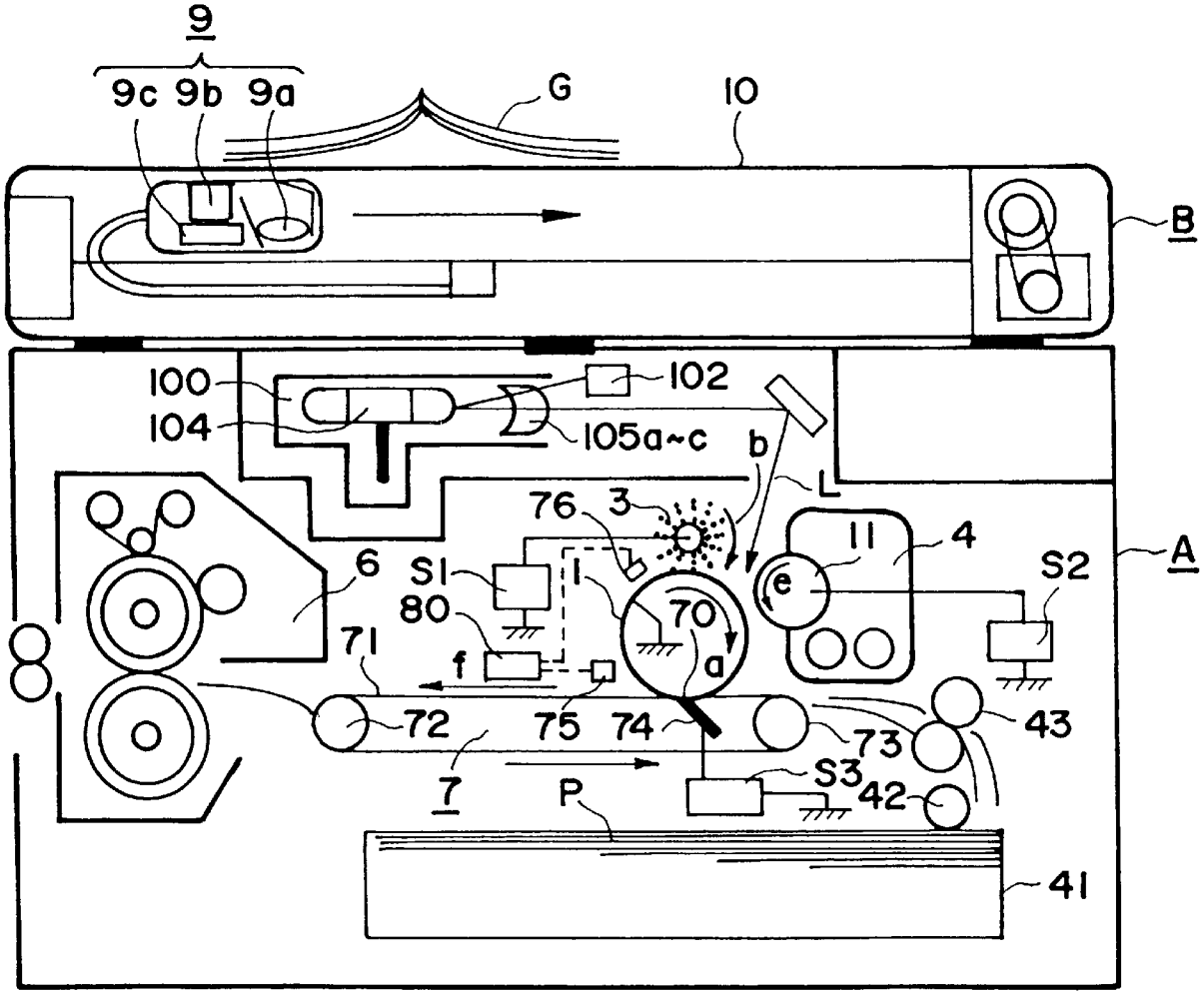
FIG. 7 is a schematic section of a modified version of the image forming apparatus in the first embodiment of the present invention, and depicts the general structure of the modified version.

In order to determine whether it is necessary to prolong the time for the post-paper jam reset sequence, a sensor 76 capable of detecting the amount of the residual toner on the photosensitive drum 1 may be disposed on the upstream side of the magnetic brush 3 relative to the rotational direction of the photosensitive drum 1, as illustrated by FIG. 7. With this arrangement, the controlling apparatus (CPU) 80 determines when to end the reset sequence, based on the value of the toner detection signal sent from the sensor 76. The residual toner detection sensor 76 may be such a sensor that comprises a light emitting source, for example, an LED, and a light receptor, for example, a phototransistor. It detects the presence of the residual toner based on the amount of the reflected light received by the receptor.

As described above, according to this embodiment, even if the toner image formed on the photosensitive drum 1 fails to be transferred onto the transfer sheet P due to the occurrence of an operational malfunction such as paper jam, the toner of the untransferred toner image is prevented from mixing into the magnetic brush 3. Therefore, the nonuniform charging of the photosensitive drum 1 attributable to the excessive amount of toner which is in the magnetic brush 3, or adhering to the surface of the magnetic brush 3, can be eliminated; one of the causes of image anomaly is eliminated to produce a desirable image.

Further, even if a substantial amount of toner mixes into the magnetic brush 3, the toner in the magnetic brush 3 can be returned during the reset sequence.

Thus, according to the present invention, it is possible to eliminate such problems that are liable to occur in an image forming apparatus in which the contact type charging means is a magnetic brush as it is in this embodiment; for example, the nonuniform charging of a photosensitive member which occurs due to the instable contact between the photosensitive member and the magnetic brush attributable to the decrease in the amount of the magnetic particles which form the magnetic brush, anomalies such as streakiness attributable to the magnetic particles which separate from the magnetic brush and mix into the developing means, and the charge failure attributable to the loss of the magnetic particles which form the magnetic brush. Therefore, desirable images can be continuously produced for an extended period.

Further, in this embodiment, it is desirable that the amplitude of the alternating voltage (AC voltage) applied together with the DC voltage to the magnetic brush 3, that is, the contact type charging means, is reduced during the post-paper jam reset sequence (according to the experiments conducted by the inventors of the present invention, the peak-to-peak voltage of the alternating voltage is desired to be no more than 200 Vpp). Also, during the post-paper jam reset sequence, the frequency of the alternating voltage is desired to be increased to 4 kHz or higher. In addition, the duty ratio may be changed to obtain better results.

Further, instead of providing a specific post-paper jam reset sequence as described above, a sequence similar to the post-paper jam reset sequence may be carried out in the warm-up period, that is, the period between the time when the main power source of an image forming apparatus is turned on, and the time when the apparatus enters the standby state.

The above described sequence, during which the frequency of the oscillating component of the bias applied to a charging device is increased as it is during the post-paper jam reset sequence, may be carried out during a period such as the period in which the photosensitive member is preliminarily rotated (FIG. 9), or the period immediately after the photosensitive member is charged for image formation, in other words, during a period in which the portion of the peripheral surface of the photosensitive member, which is not going to be immediately used for an image forming operation, is at the charging point.

The aforementioned period in which a photosensitive drum is preliminarily rotated means a period from the time when the rotation of the photosensitive member is started by the image formation start signal externally given to an image forming apparatus, to the time when the leading edge of a given peripheral surface area, which is to be used for the immediate image forming operation, of the photosensitive member, arrives at the charging point. The aforementioned period immediately after a photosensitive member is charged for image formation means a period from the time when the trailing edge of a given peripheral surface area, which is being used for the current image forming operation, of the photosensitive member, passes the charging point, to the time when the rotation of the photosensitive member is stopped after the completion of the immediately preceding image forming operation.

Embodiment 2

Figure 8:
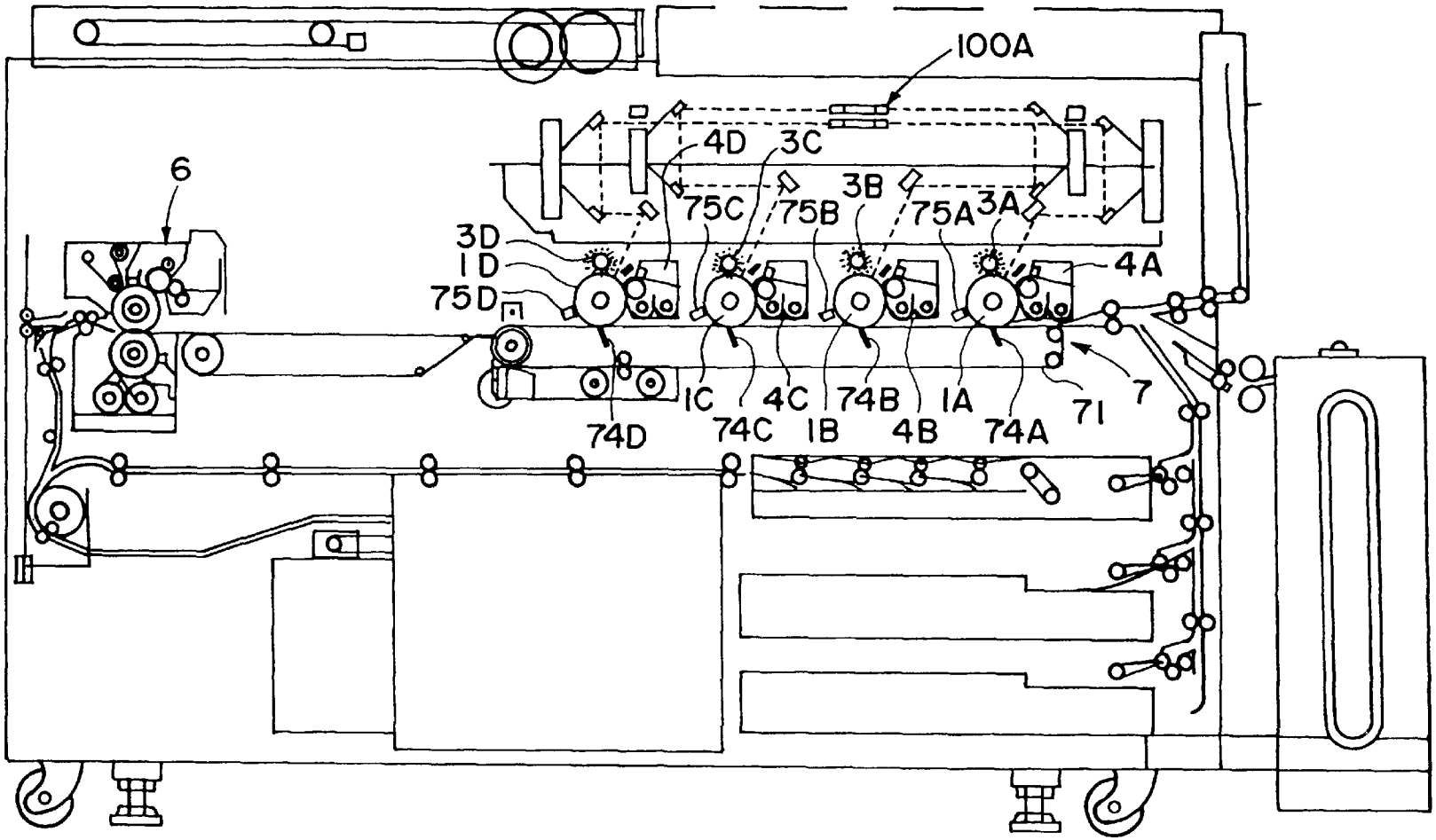
FIG. 8 is a schematic section of the image forming apparatus in the second embodiment of the present invention, and depicts the general structure of the apparatus.

FIG. 8 is a schematic section of the image forming apparatus in the second embodiment of the present invention, and depicts the general structure of the apparatus. This apparatus is an electrophotographic multicolor copying apparatus (image forming apparatus). It comprises a plurality (four in this embodiment) of image formation units, which have photosensitive members 1A, 1B, 1C and 1D, one for one.

Similarly to the first embodiment, magnetic brushes 3A, 3B, 3C and 3D, developing apparatuses, 4A, 4B, 4C and 4D, and transfer sheet sensors 75A, 75B, 75C and 75D, are disposed along the peripheral surfaces of the photosensitive members 1A, 1B, 1C and 1D, correspondingly. Also, a transferring apparatus 7 comprising transfer charge blades 74A, 74B, 74C and 74D, which are correspondent to the photosensitive members 1A, 1B, 1C and 1D, and a transfer belt 71, is disposed almost in contact with the bottom sides of the photosensitive members 1A, 1B, 1C and 1D. The transfer sheet sensors 75A, 75B, 75C and 75D are connected to an unillustrated controlling apparatus (CPU). The apparatuses designated with referential codes 6 and 100A are a fixing apparatus, and an exposing apparatus, respectively.

The control executed in this embodiment is similar to the one described in the first embodiment. That is, as paper jam occurs during an image forming operation, the controlling apparatus senses the occurrence of paper jam, based on the signal sent from one of the transfer sheet sensors 75A, 75B, 75C and 75D, or two or more signals sent from any combination of the transfer sheet sensors 75A, 75B, 75C and 75D, and immediately stops the operations directly related to image formation.

Then, the controlling apparatus executes a reset sequence similar to the one described in the first embodiment, in which the frequency of the oscillating component of the electrical bias applied to the magnetic brushes 3A, 3B, 3C and 3D is rendered higher than the frequency during an actual image forming operation, and the DC component of the development bias applied to the development sleeves 4A, 4B, 4C and 4D, of the developing apparatuses 4A, 4B, 4C and 4D, is modified so that its absolute value becomes slightly smaller than the absolute value during an actual image forming operation. In this embodiment, the value of the DC component is reduced from −500 V, which corresponds to an actual image forming operation, to −450 V. Further, the image forming apparatus in this embodiment is constructed so that the transfer belt 71 is moved away from the photosensitive members 1A, 1B, 1C and 1D during a reset sequence.

Thus, according to this embodiment, in addition to the effects described in the first embodiment, it is possible to prevent the occurrence of image anomaly attributable to the color mixture in the developing apparatuses 4A, 4B, 4C and 4D, which is caused by the toner of the toner image, which remains on a given photosensitive member, or given photosensitive members, due to paper jam or the like, and then, mechanically adheres to the transfer belt 71, is conveyed by the transfer belt 71, and transfers to the photosensitive members on the downstream side.

The application of the present invention is not limited to the apparatuses described in the preceding embodiments. For example, the present invention is also applicable to an apparatus in which contact type charging means is constituted of a charge roller formed of electrically conductive rubber or electrically conductive sponge, or an apparatus in which contact type charging means is constituted of a nonrotative magnetic brush or a nonrotative fiber brush. In other words, the present invention is applicable to almost any apparatus which employs a contact type charging means. As for the rotational direction, in a contact nip, of a contact type charging means, a contact type charging means may be rotated in the same direction as a photosensitive drum, or may be stationary.

Although, from the standpoint of charge injection, and prevention of ozone generation, it is desirable that a photosensitive drum has a low resistance surface layer, that is, a surface layer with a volumetric resistivity of $10^9$–$10^{14}$ ohm.cm, but the present invention is also applicable to prevent the contamination of a contact type charging means for charging an organic photosensitive member other than a photosensitive member such as the one described above.

The transferring means does not need to be a belt type transferring apparatus; the present invention is also compatible with a transfer roller or a corona type transfer charger.

As for the oscillating voltage applied to a charging device, it may be generated by periodically switching the output voltage of a DC power source, as long as the wave-form of the thus obtained oscillating voltage is the same as the wave-form of the compound voltage composed of AC voltage and DC voltage, which was described in the first embodiment. Further, the oscillating voltage may be in the form of a sine wave, a triangular wave, or pulse wave.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member;

latent image forming means for forming an electrostatic latent image on said image bearing member, said latent image forming means having a charging member contactable to said image bearing member to electrically charge said image bearing member, and said charging member being supplied with a voltage comprising an oscillation component;

developing means for developing the electrostatic latent image with toner into a toner image, said developing means removing residual toner from said image bearing member while developing the electrostatic latent image; and transfer means for transferring the toner image from said image bearing member onto a transfer material;

frequency control means for controlling a frequency of the oscillation component so that the frequency is higher when at least a part of such an area of the image bearing member as is going to be a non-image area is charged than when such an area of the image bearing member as is going to be an image area is charged.

2. An image forming apparatus according to claim 1, wherein said control means increases the frequency upon a preparatory process when an operation is resumed after jamming of the transfer material.

3. An image forming apparatus according to claim 1, wherein the frequency which is higher is not less than 4 KHz.

4. An image forming apparatus according to claim 1, wherein the frequency when the area which is going to be the image area is charged is 500 to 3000 Hz.

5. An image forming apparatus according to claim 2, wherein in the preparatory process, the toner image remaining on said image bearing member is not transferred onto the transfer material by said transfer means, but is passed through a transfer position.

6. An apparatus according to claim 1, wherein a charging polarity of said charging member is the same as a charging polarity of the toner image.

7. An apparatus according to claim 6, wherein when an area which has passed through a charging position where said charging member charges said image bearing member in a period in which the frequency is higher, is at a developing position where said developing means develops the latent image, a DC component of a voltage applied to said developing means is smaller than when the image area is at the developing position.

8. An image forming apparatus according to claim 1, further comprising voltage control means for decreasing a peak-to-peak voltage of the oscillation component in interrelation with increase of the frequency.

9. An apparatus according to claim 1, wherein said developing means removes the residual toner from said image bearing member simultaneously with developing operation.

10. An apparatus according to any one of claims 1–9, wherein said image bearing member has a surface layer having a volume resistivity of $10^9$–$10^{14}$ Ohm.cm.

11. An apparatus according to claim 10, wherein said image bearing member is provided with an electrophotographic photosensitive layer inside the surface layer.

12. An apparatus according to claim 10, wherein said surface layer comprises resin material and electroconductive particles.

13. An apparatus according to any one of claims 1–9, wherein said charging member has a magnetic brush contactable to said image bearing member.

* * * * *